US006854508B2

(12) United States Patent
Zajber et al.

(10) Patent No.: US 6,854,508 B2
(45) Date of Patent: Feb. 15, 2005

(54) DUMMY BAR FOR A CONTINUOUS METAL CASTING PLANT, PARTICULARLY FOR A CONTINUOUS CASTING PLANT FOR PRELIMINARY STEEL SECTIONS

(75) Inventors: Adolf Zajber, Langenfeld (DE); Thomas Fest, Duisburg (DE)

(73) Assignee: SMS Demag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 10/003,032

(22) Filed: Nov. 15, 2001

(65) Prior Publication Data

US 2002/0084055 A1 Jul. 4, 2002

(30) Foreign Application Priority Data

Nov. 16, 2000 (DE) ..... 100 56 911

(51) Int. Cl.[7] ..... B22D 11/08
(52) U.S. Cl. ..... 164/445; 164/425; 164/426
(58) Field of Search ..... 164/425, 445, 164/426

(56) References Cited

U.S. PATENT DOCUMENTS 3,800,849 A * 4/1974 Knell et al. ..... 164/483
4,178,000 A * 12/1979 Kuttner ..... 277/468
5,197,533 A * 3/1993 Behrends ..... 164/446

FOREIGN PATENT DOCUMENTS

JP 56-80364 * 7/1981
WO 9746343 12/1997

* cited by examiner

*Primary Examiner*—Kuang Y. Lin
(74) *Attorney, Agent, or Firm*—Friedrich Kueffner

(57) ABSTRACT

A dummy bar for a continuous metal casting plant, particularly for a continuous casting plant for preliminary steel sections, includes a one-piece head piece having dimensions corresponding to the dimensions of the mold cross-section and two rows of segments connected to the head piece. The two rows of segments extend parallel to each other in the longitudinal direction of the dummy bar and are spaced apart from each other by the width of the dummy bar. Flexible steel bands are mounted on each row of segments for connecting the segments.

8 Claims, 1 Drawing Sheet

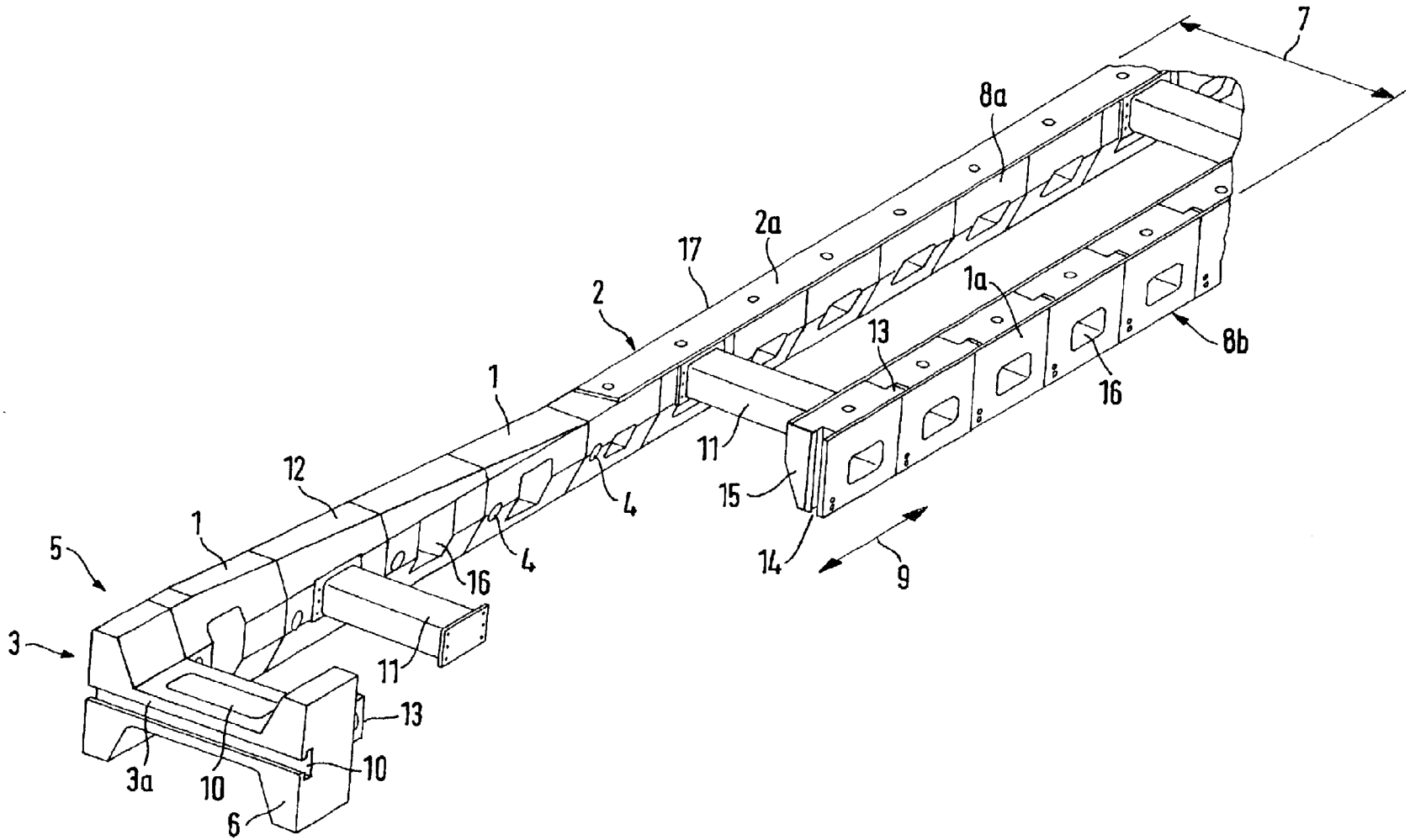
7
8b
16
8a
1a
13
9
14
15
2a
11
17
2
4
1
4
16
11
13
10
12
10
6
1
3a
5
3

DUMMY BAR FOR A CONTINUOUS METAL CASTING PLANT, PARTICULARLY FOR A CONTINUOUS CASTING PLANT FOR PRELIMINARY STEEL SECTIONS

BACKGROUND OF THE INVENTION

1. Field of the Invention

The invention relates to a dummy bar or starter bar for a continuous metal casting plant, particularly for a continuous casting plant for producing preliminary steel sections. The dummy bar includes at least one flexible steel band; the head of the dummy bar is capable of closing the cross section of the mold; and individual segments are connected through the flexible steel band along the length of the steel band up to the end thereof.

2. Description of the Related Art

A dummy bar of the above-described type is disclosed in WO 97/46343. The dummy bar is constructed for the casting of preliminary sections. The dummy bar has a uniform transition portion composed of individual segments which are combined to form a H-shaped cross-section and are attached to the flexible steel band which forms the core of the dummy bar. The transition portion is releasably connected to a standard portion which is also connected to a flexible steel band. However, the H-shaped cross-section is formed of a plurality of cover plates and side plates so that the manufacture is complicated and the dummy bar must be assembled from a large number of components. The dummy bar also has a great weight. Another disadvantage is the reduced flexibility of the dummy bar so that greater force must be applied for conveying the dummy bar along curved portions of the strand guiding means.

SUMMARY OF THE INVENTION

Therefore, it is the primary object of the present invention to improve the flexibility of such a dummy bar, so that a dummy bar with a lower weight is achieved which requires reduced force application for the transport and manipulation thereof.

In accordance with the present invention, the above object is met by providing the beginning of the dummy bar for the cross-section of the mold with a one-piece head piece which in its dimensions corresponds to those of the cross-section of the mold, wherein two parallel rows of segments are connected to the head piece, wherein the two rows are spaced apart from each other by the width of the strand and the rows extend in the longitudinal direction of the strand, and wherein the segments of each row are connected to each other through a flexible steel band which is mounted on the segments and ensures that the rows of segments are bendable along curves.

As a result of the configuration of the present invention, the steel band provides a better flexibility or articulation because the steel band is located on the inner side of curved portions and on the outer side of the row of segments. This reduces the bending work which has to be performed. Another advantage is the fact that the segments can be guided without play. In addition, there is the advantage that in continuous casting plants for preliminary sections the cross-section of the two rows of segments can follow and simply form a continuation of the cast section.

The restoring force when bending the steel strip and the capability of absorbing bending forces can be further improved if the flexible steel band is constructed as a spring steel band.

In accordance with a further development of the invention, the head piece has at least one recess extending transversely of the longitudinal direction of the dummy bar for connecting the dummy bar to the hot strand. This makes it unnecessary to use conventional tongue-shaped elements for disconnecting.

In accordance with other features, cross-connecting elements are provided between the two rows of segments and spaced apart from each other in the longitudinal direction of the dummy bar, wherein the cross-connecting elements are attached to two oppositely located segments. The advantage of this configuration is a parallel guidance of the two rows of segments and stiffening of the entire dummy bar without significantly increasing the weight of the dummy bar.

In accordance with another advantageous feature, the segments following the head piece in the longitudinal direction of the dummy bar are constructed as transition segments having a reduced thickness. As a result, a weight reduction of the segments is achieved beginning with the first segment following the head piece so that the following segments have a smaller thickness and, thus, a lower weight.

In accordance with another development, the segments of a row of segments are connected to each other in an articulated and pivotable manner by means of keys and slots. The bending movement of the segments relative to each other advantageously takes place in a vertical plane so that a lateral guidance is effective at the same time.

In accordance with a further development, the individual segments are bevelled so as to downwardly recede at the oppositely located surfaces of the two rows. Consequently, the dummy bar can be guided on the lower side thereof and/or at the cross-connecting elements.

In accordance with another advantageous feature, the head piece and/or the individual segments are provided with inner hollow spaces to reduce the weight. The weight reduction is very significant in dependence on the number of segments without leading to a weakening of the dummy bar.

In accordance with another proposed feature, the spring steel bands are screwed or riveted to each row of segments. This simplifies the assembly.

Finally, the dummy bar can be used in an advantageous manner if the two rows of segments with spring steel bands mounted thereon are spaced apart from each other in accordance with the width of a H-section of the hot strand.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

The single FIGURE of the drawing is a perspective view of a dummy bar for the continuous casting mold area of a continuous casting plant.

DESCRIPTION OF THE PREFERRED EMBODIMENTS

The dummy bar illustrated in the drawing is used for a continuous metal casting plant, particularly a continuous casting plant for producing preliminary steel sections. However, the dummy bar can also be used for slab strands, block strands, or the like.

The individual segments 1 are connected to each other by means of a flexible steel band 2 in the form of a spring steel band 2*a*. The head 3 consists of a one-piece head piece 3*a* which closes off the mold cross-section or casting cross-section. The spring steel band 2*a* starts at least at the segments 1*a* which have a reduced thickness. The segments 1 located between the head piece 3*a* and the segments 1*a* having a reduced thickness can also be connected to each other in an articulated manner through bolts 4. In the illustrated embodiment, the spring steel band 2*a* begins at the segments 1*a* having a reduced thickness.

Connected to the beginning 5 for the mold cross-section 6 are two rows 8*a* and 8*b* of segments 1 which extend parallel to each other in the longitudinal direction 9 of the dummy bar. These segments 1 can bend along curved portions and are connected within each row 8*a* and 8*b* by flexible steel bands 2 mounted 6*n* the segments 1. The flexible steel band 2 is constructed as a spring steel band 2*a*. Provided in the one-piece head piece 3*a* is at least one recess 10 extending transversely of the longitudinal direction 9 of the dummy bar for effecting the connection to the hot strand. Cross-connecting elements 11 are provided between the two rows 8*a* and 8*b* of segments 1, wherein the cross-connecting elements 11 are arranged spaced apart from each other in the longitudinal direction 9 and are connected to segments 1 of each row located opposite each other. The segments 1*a* following the head piece 3*a* in the longitudinal direction 9 are constructed with decreasing thickness. In order to be able to carry out a curved movement within a vertical plane, the segments 1 of each of the rows 8*a* or 8*b* are connected to each other in an articulated manner by means of keys 13 and slots 14.

The individual segments 1 are bevelled so as to recede downwardly at opposite surfaces 15 of the two rows 8*a* and 8*b*.

For weight reduction, the head piece 3*a* and/or the individual segments 1 are provided with hollow spaces 16.

The spring steel bands 2*a* are screwed or riveted to the respective rows 8*a* and 8*b* of segments 1.

To provide for the special case of casting preliminary strands, such as I-strands or H-section strands, the two rows 8*a* and 8*b* of segments 1 with spring steel bands 2*a* mounted thereon are spaced apart from each other in accordance with the width of a I-shape or H-shape of the hot strand.

While specific embodiments of the invention have been shown and described in detail to illustrate the inventive principles, it will be understood that the invention may be embodied otherwise without departing from such principles.

We claim:

1. A dummy bar for a continuous casting plant for preliminary steel sections having an I-shape or H-shape, the dummy bar comprising:

a one-piece head piece having dimensions corresponding to dimensions of a mold cross-section, two rows of segments connected to the head piece, wherein the two rows extend parallel to each other in a longitudinal direction of the dummy bar and are spaced apart from each other by a width of the dummy bar, the segments being beveled so as to downwardly recede at oppositely located surfaces of the two rows of segments, further comprising:

a single continuous flexible spring steel band mounted on each row of segments for connecting the segments, wherein each flexible spring steel band is located on an inner side of a curved portion of the dummy bar and on an outer side of the row of segments.

2. The dummy bar according to claim 1, wherein the head piece has at least one recess extending transversely of the longitudinal direction of the dummy bar for connecting the dummy bar to a hot strand.

3. The dummy bar according to claim 1, further comprising cross-connecting elements arranged between the two rows of segments and spaced apart from each other in the longitudinal direction, wherein each cross-connecting member is attached to two oppositely located segments of the two rows.

4. The dummy bar according to claim 1, wherein the segments following the head piece in the longitudinal direction are transition segments having a reduced thickness.

5. The dummy bar according to claim 1, wherein the segments of each row are connected to each other in an articulated pivotable manner by means of key and slot connections.

6. The dummy bar according to claim 1, wherein at least one of the head pieces and the individual segments have inner hollow spaces for weight reduction.

7. The dummy bar according to claim 1, wherein each spring steel band is screwed or riveted to the row of segments.

8. The dummy bar according to claim 1, wherein the two rows of segments with spring steel strips mounted thereon are spaced apart from each other in accordance with a width of a H-shaped profile of a hot strand.

* * * * *